United States Patent [19]

Ishii

[11] Patent Number: 4,867,112

[45] Date of Patent: Sep. 19, 1989

[54] METHOD OF ASSEMBLING A VALVE-LASH ADJUSTER FOR INTERNAL COMBUSTION ENGINES

[75] Inventor: Norio Ishii, Mitaka, Japan

[73] Assignee: Fuji Jukogyo Kabushiki Kaisha, Tokyo, Japan

[21] Appl. No.: 182,985

[22] Filed: Apr. 18, 1988

[30] Foreign Application Priority Data

Apr. 24, 1987 [JP] Japan ..... 62-101490

[51] Int. Cl.[4] ..... F01L 1/18; F01L 1/20

[52] U.S. Cl. ..... 123/90.45; 123/90.54

[58] Field of Search ..... 123/90.45, 90.54; 24/156.7 B

[56] References Cited

U.S. PATENT DOCUMENTS

| | | | |
|---|---|---|---|
| 2,418,110 | 4/1947 | Burkhardt | 123/90.45 |
| 2,467,079 | 4/1949 | Corlett | 29/156.7 B |
| 3,024,775 | 3/1962 | Wuest | 123/90.45 |
| 3,538,894 | 11/1970 | Kogan | 123/90.45 |
| 4,497,307 | 2/1985 | Paar et al. | 123/90.45 |
| 4,548,168 | 10/1985 | Gill | 123/90.45 |

FOREIGN PATENT DOCUMENTS 62-35005 2/1987 Japan .

*Primary Examiner*—Willis R. Wolfe
*Assistant Examiner*—M. Macy
*Attorney, Agent, or Firm*—Martin A. Farber

[57] ABSTRACT

A valve-lash adjuster has a cylindrical hold screw having a male thread on a periphery thereof and a female thread at an upper portion of a bore thereof, and a cylindrical piston having a female thread at an upper portion thereof. The hold screw is screwed in a female thread formed in an end of a rocker arm, and the piston is inserted in a bore of hold screw, and temporarily secured to the hold screw. After a clearance between the piston and a stem of the valve mechanism is adjusted, the piston is removed from the hold screw, and a spring is inserted in the removed piston, and the piston having the spring is engaged in the hold screw.

2 Claims, 3 Drawing Sheets

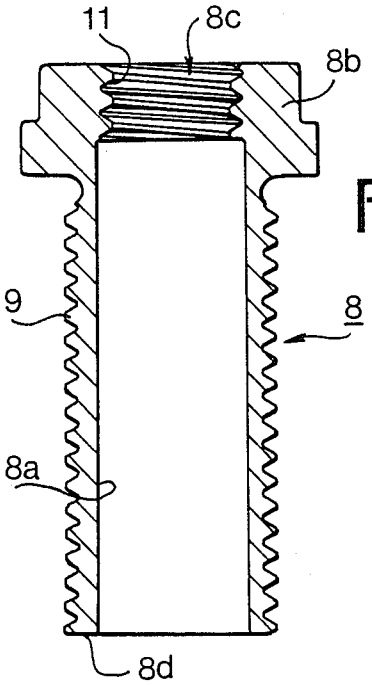
FIG. 2
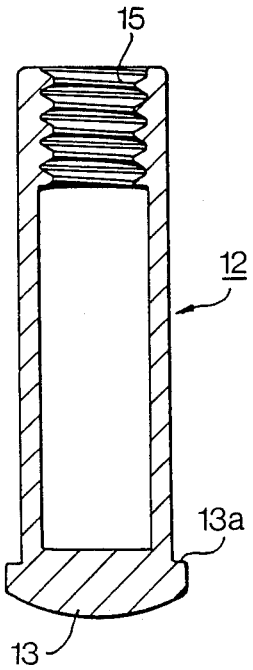
FIG. 3
FIG. 4
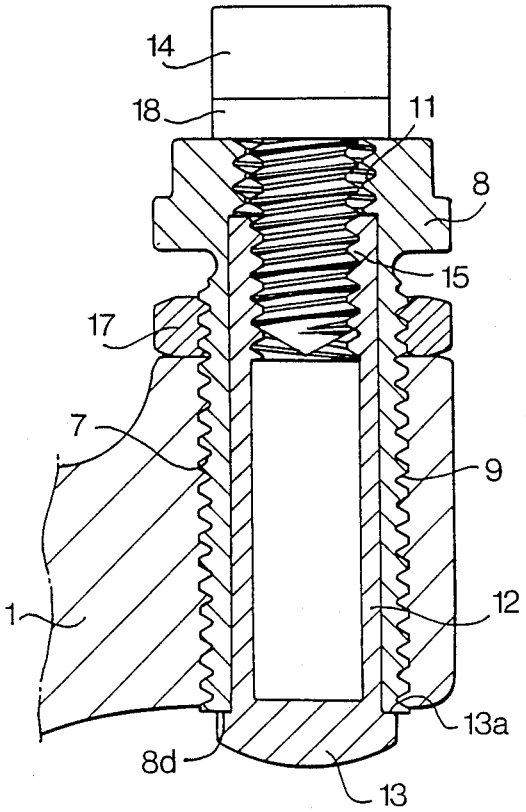

METHOD OF ASSEMBLING A VALVE-LASH ADJUSTER FOR INTERNAL COMBUSTION ENGINES

BACKGROUND OF THE INVENTION

The present invention relates to a method of assembling a valve-lash adjuster, with adjusting a valve clearance in a valve mechanism for an automotive engine.

A valve lift mechanism which enables to change the valve lift by employing an eccentric rocker shaft is well known. Such a mechanism is generally provided with a valve-lash adjuster incorporated in a rocker arm. The lash adjuster has a piston outwardly urged by a spring so as to act as a shock absorber, which is disclosed in Japanese Patent Laid Open No. 62-35005. Referring to FIG. 6 showing a conventional valve-lash adjuster, a rocker arm 21 is provided with a bore 21*a* at an end, which has a shock absorbing spring 22 therein. A screw 23 is screwed in an upper portion of the bore 21*a* and secured thereto by a nut 24 for preventing the screw 23 from rotating. A piston 25 having a flange 25*a*, the underside of which engages a shoulder 21*b* formed in the bore 21*a*, is disposed in the lower portion of the bore 21*a* opposing the screw 23. Thus, the piston 25 elastically abuts on a top of a valve stem (not shown).

In the above-described conventional valve-lash adjuster, the screw 23 is screwed in the bore 21*a* to adjust the valve clearance after an elastic member such as the spring 22 had been inserted. In order to adjust the clearance for between the piston and the valve stem, a thickness gauge is inserted in the clearance, and the screw 23 is rotated. However, since the piston 25 is retracted into the bore 21*a*, compressing the spring 22, it is difficult to accurately adjust the clearance.

SUMMARY OF THE INVENTION

The object of the present invention is to provide a method of assembling a valve-lash adjuster whereby the valve clearance can be accurately adjusted, thereby facilitating the assemblage operation.

According to the present invention, there is provided a method of assembling a valve-lash adjuster of a valve mechanism of an automotive engine, which has a cylindrical hold screw having a male thread on a periphery thereof and a female thread at an upper portion of a bore thereof, and a cylindrical piston having a female thread at an upper portion thereof and a head for abutting a stem of the valve mechanism.

The method comprises screwing the hold screw in a female thread formed in an end of a rocker arm of the valve mechanism, inserting the piston in the bore of the hold screw, temporarily securing the piston to the hold screw, adjusting a clearance between the piston and a stem of the valve mechanism, removing the piston from the hold screw, inserting a spring in the removed piston, and engaging the piston having the spring in the hold screw.

In an aspect of the invention, the piston is temporarily secured to the hold screw by engaging a false bolt with both of the hold screw and the piston.

The other object and features of this invention will be apparently understood from the following description with reference to the accompanying drawings.

BRIEF DESCRIPTION OF DRAWINGS

FIGS. 2 and 3 are sectional views of a hold screw and a piston of a valve-lash adjuster, respectively;

FIG. 4 is a sectional view of the valve-lash adjuster in a temporarily assembled state;

DETAILED DESCRIPTION OF THE PREFERRED EMBODIMENT

Figures 1, 1A:
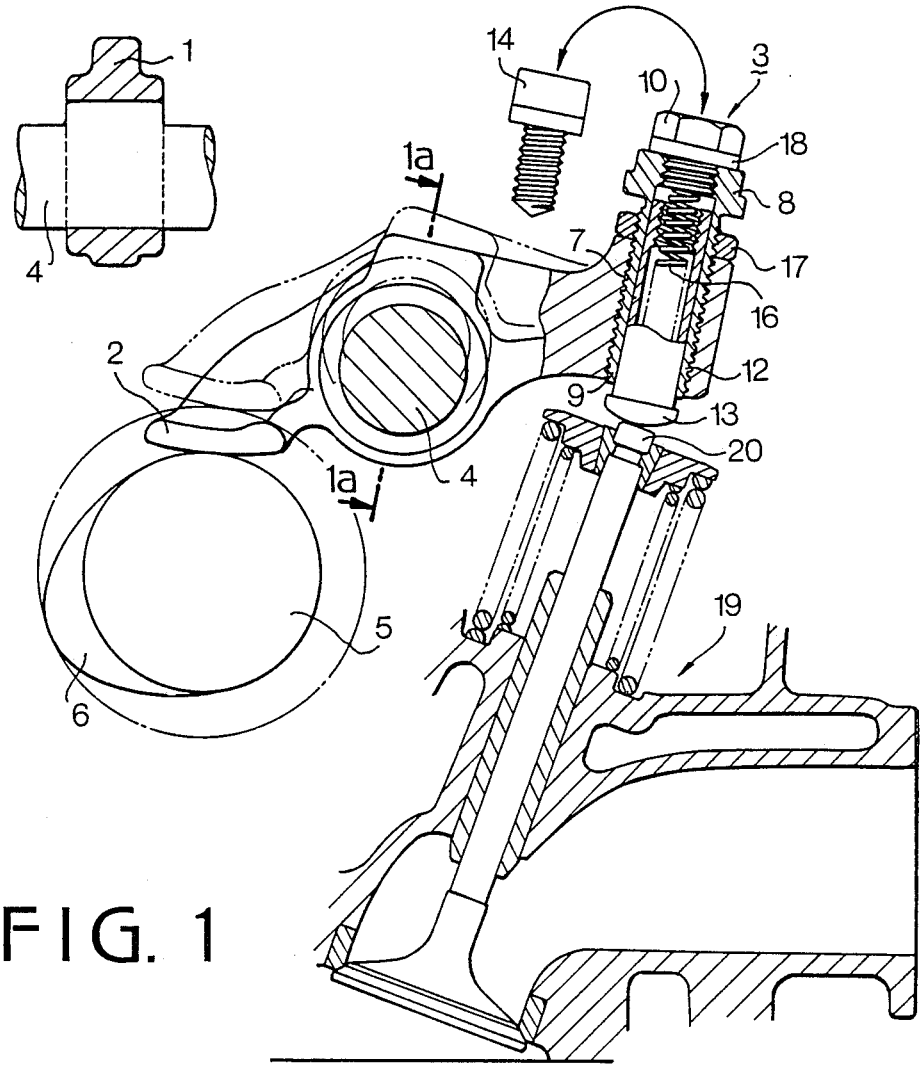
FIG. 1 is a fragmentary sectional side view of a part of a valve mechanism which is assembled in accordance with the 10 present invention.
FIG. 1*a* is a sectional view taken along a line 1*a*–1*a* in FIG. 1.

Referring to FIGS. 1 to 3, a valve mechanism 19 for a valve, for example, an intake valve, comprises a camshaft 5, a cam 6 formed on the camshaft 5, a rocker arm shaft 4 eccentrically mounted so as to change the valve lift, and a rocker arm 1 pivotally mounted on the rocker arm shaft 4.

One end of the rocker arm 1 is provided with a slipper 2 which is pressed against the cam 6. At the other end of the rocker arm 1, a valve-lash adjuster 3 is provided as described later. The valve-lash adjuster 3 comprises a hold screw 8, and a cylindrical piston 12 inserted in the hold screw 8. The hold screw 8 has a male thread 9 for engaging with a female thread 7 formed in the inner periphery of a bore and with a lock nut 17.

As shown in FIG. 2, the hold screw 8 further has an axial bore 8*a* wherein the piston 12 is inserted. An axial bore 8*c* which has a smaller diameter than the bore 8*a* and a female thread 11 formed on an inner periphery thereof, is formed in an upper portion 8*b* of the hold screw 8.

The piston 12 has a head 13 at the bottom end which abuts against a top of a valve stem 20. On the upper inner periphery of the piston 12 is formed a female thread 15 which engages with a thread of a false bolt 14 for temporarily holding the piston 12 in the hold screw 8. The inner diameter of the upper portion of the piston 12 is equal to the inner diameter of the bore 8*c* so that the bolt 14 is able to engage with both threads 11 and 15. The bolt 14 is exchanged for a bolt 10 having a shorter stem after adjusting the valve clearance and inserting a shock absorbing spring 16 in the piston 12. A spring washer 18 is interposed between the hold screw 8 and the bolt 10 or the false bolt 14.

Figure 5:
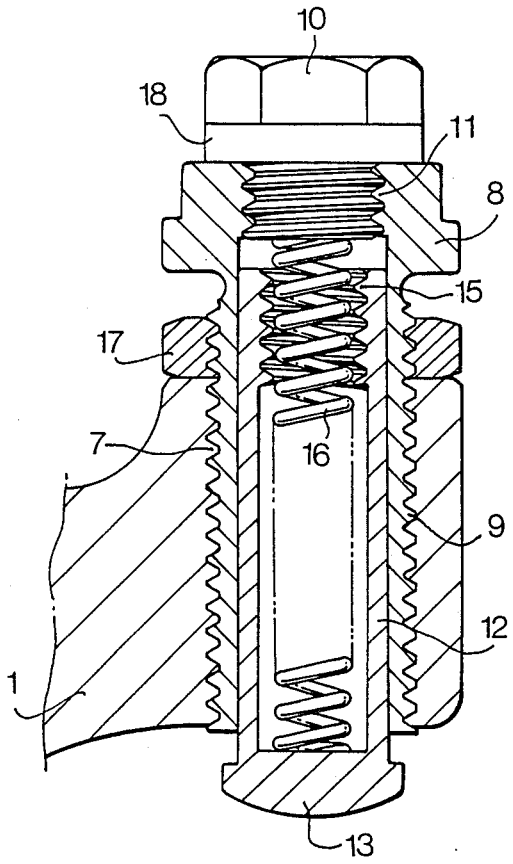
FIG. 5 is a sectional view of the completed valve-lash adjuster.
Figure 6:
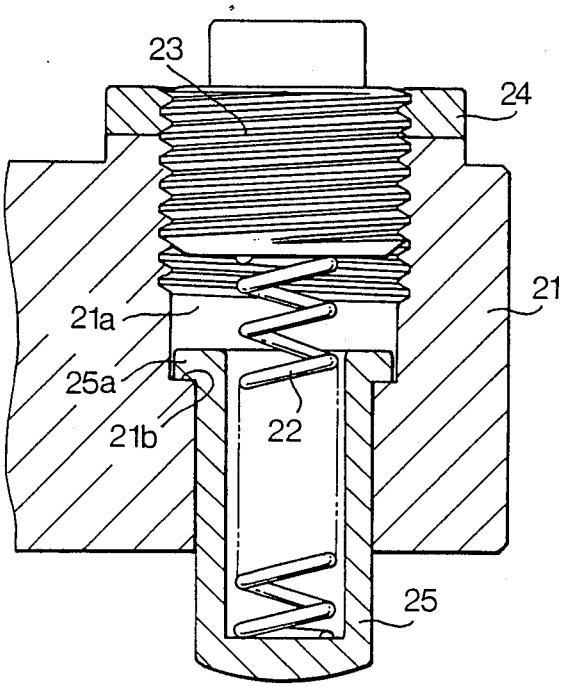
FIG. 6 is a sectional view of a conventional valve-lash adjuster.

The assemblage of the valve-lash adjuster 3 is described hereinafter with reference to FIGS. 4 and 5. The hold screw 8 with the lock nut 17 screwed on the upper periphery thereof is engaged in the bore of the rocker arm 1 through thread 7 and 9. The piston 12 is inserted in the hold screw 8 in the innermost position, that is until a shoulder 13*a* of the head 13 abuts on the bottom edge 8*d* of the hold screw 8. Thereafter, the bolt 14 is screwed in the hold screw 8, interposing the spring washer 18. The bolt 14 engages with the thread 11 and with the thread 15 of the piston 12 so that the piston 12 is held in the hold screw 8 at the innermost position. The lock nut 17 is released and the hold screw 8 is turned to adjust the relative position of the hold screw 8 in the bore of the rocker arm 1. The adjustment is done by inserting thickness gauges into the space between the head 13 of the piston 12 and the valve stem 20, thereby adjusting the valve clearance. At the desired position, hold screw 8 is secured by the lock nut 17.

After the valve clearance adjustment is completed, the false bolt 14 is removed and the piston 12 is taken out of the hold screw 8. The spring 16 is inserted in the piston 12 which is again set in the hold screw 8 thereafter. The bolt 10 is screwed in the upper portion 8*b* of the hold screw 8 through the thread 11, interposing the spring washer 18, thereby pushing down the spring 16. Accordingly, the spring 16 urges the head 13 toward the valve stem 20.

From the foregoing, it will be understood that the present invention provides a method of adjusting valve clearance wherein elasticity of the spring does not affect the adjustment of the clearance. Accordingly, the efficiency of the assemblage operation of the valve-lash adjuster is heightened.

While the presently preferred embodiment of the present invention has been shown and described, it is to be understood that this disclosure is for the purpose of illustration and that various changes and modifications may be made without departing from the scope of the invention a set forth in the appended claims.

What is claimed is:

1. A method of assembling a valve-lash adjuster of a valve mechanism of an automotive engine, which has a cylindrical hold screw having a male thread on a periphery thereof and a female thread at an upper portion of a bore thereof, and a cylindrical piston having a female thread at an upper portion thereof and a head for abutting a stem of the valve mechanism comprising:

screwing the hold screw in a female thread formed in an end of a rocker arm of the valve mechanism;

inserting the piston in the bore of the hold screw;

temporarily securing the piston to the hold screw;

adjusting a clearance between the head and the stem 20;

removing the piston from the hold screw;

inserting a spring in the removed piston; and engaging the piston having the spring in the hold screw.

2. The method according to claim 1 wherein the piston is temporarily secured to the hold screw by engaging a false bolt with both of the hold screw and the piston.

* * * * *